US007179212B2

(12) United States Patent
Hsiung et al.

(10) Patent No.: US 7,179,212 B2
(45) Date of Patent: Feb. 20, 2007

(54) OMNI-DIRECTIONAL ABDOMINAL EXERCISER

(75) Inventors: Bob Hsiung, Walnut, CA (US); Chin-Ta Lin, Tai-Pin (TW)

(73) Assignee: Hupa International, Inc., Walnut, CA (US)

( * ) Notice: Subject to any disclaimer, the term of this patent is extended or adjusted under 35 U.S.C. 154(b) by 252 days.

(21) Appl. No.: 11/002,751

(22) Filed: Dec. 1, 2004

(65) Prior Publication Data

US 2006/0116261 A1 Jun. 1, 2006

(51) Int. Cl.
*A63B 26/00* (2006.01)

(52) U.S. Cl. ..... 482/140

(58) Field of Classification Search ..... 482/140, 482/142, 907, 148; D21/676, 686, 662, 690
See application file for complete search history.

(56) References Cited

U.S. PATENT DOCUMENTS

D390,664 S * 2/1998 Chun-Chung ..... D24/183
D476,384 S * 6/2003 Perez ..... D21/690
6,749,549 B1 * 6/2004 Chu ..... 482/148
D499,457 S * 12/2004 Kuo ..... D21/690
D503,757 S * 4/2005 Sjurdagardi ..... D21/691
2003/0130100 A1 * 7/2003 Perez ..... 482/140
2003/0171194 A1 * 9/2003 Chung ..... 482/123
2004/0067824 A1 * 4/2004 Chung-Ting ..... 482/93

* cited by examiner

*Primary Examiner*—Lori Amerson
(74) *Attorney, Agent, or Firm*—Thomas I. Rozsa; Tony D. Chen

(57) ABSTRACT

An abdominal exerciser which is characterized in that the moveable mechanism has a main shaft end portion mounted with a leg-hooking module and the top face of the end of the main shaft is a seat pad, and the two lateral walls of the main shaft corresponding to the middle section of the seat pad is extended with a hollow inner clutching member. The end face of the hollow clutching member corresponding to one lateral side of the leg-hooking module is extended with an extended engaging block. The interior of the inner clutching member is provided with a rod for pivotal mounting. The top portion of the two ends of the first supporting frame is formed into a first clutching member which corresponds to the rod. A twisting module is also formed in the abdominal exerciser to permit both rocking seesaw motion and twisting motion.

23 Claims, 7 Drawing Sheets

OMNI-DIRECTIONAL ABDOMINAL EXERCISER

BACKGROUND OF THE INVENTION

1. Field of the Invention

The present invention relates to exercise apparatus and more particularly, to an exercise apparatus which is used to exercise the abdomen of the human body in order to strengthen stomach muscles and flatten the stomach.

2. Description of the Prior Art

The inventor is aware of the following prior art which is related to the present invention:

1. Taiwanese Utility Model Publication No. 309775 entitled "Multifunctional Sit-Up Exerciser";
2. Taiwanese Utility Model Publication No. 354904 entitled "Multifunctional Sit-Up Exerciser";
3. Taiwanese Utility Model Publication No. 368879 entitled "Waist and Abdomen Exerciser";
4. Taiwanese Utility Model Publication No. 494775 entitled "Sit-Up Exerciser".

All of these Taiwanese Utility Model Publications employ plate bodies or metal tubes pivotally joined together to form the structure of the exercisers. The drawbacks of these structures are that in each case the structure is not rigid and the strength of the device is insufficient to support vigorous exercise and therefore, each device is shaky when in use. In other words, the possibility of dislocation between the joints of the structure may create a great effect on the safety of the exercisers and make them dangerous to use. Accordingly, it is an object of the present invention to provide an abdominal exerciser which mitigates the above drawbacks.

SUMMARY OF THE INVENTION

The present invention is an abdominal exercise apparatus which enables the user to engage in a dual exercise motion at the same time. One motion is a seesaw up and down motion about a horizontal axis and the other is a twisting or swiveling motion. The twisting module portion of the omni-directional abdominal exerciser permits horizontal, vertical and diagonal motions at every angle between the vertical and horizontal planes.

Accordingly, it is an object of the present invention to provide an abdominal exerciser having a framework mounted with a moveable mechanism characterized in that the moveable mechanism has a main shaft end portion mounted with a leg-hooking module and the middle face of the end of the main shaft is a seat pad with a back support at its opposite end, and the two lateral walls of the main shaft corresponding to the middle section of the seat pad include a hollow inner clutching member, the end face of the hollow clutching member corresponding to one lateral side of the leg-hooking module and extends outwardly with an extending engaging block. The interior of the inner clutching member is provided with a rod for pivotal mounting. The framework includes a first supporting frame and a second supporting frame. The top portion of the two ends of the first supporting frame is a first clutching member which corresponds to the rod. The first clutching member is mounted at the external side of the clutching member at the main shaft. The end faces of the two lateral sides of the first clutching member are formed into the extending engaging block which is different from the extending engaging block of the inner clutching member. The top portion of the two ends of the second supporting frame is formed into the second clutching member which can be pivotally mounted to the rod. The second mounting member is mounted at the external side of the first clutching member. The second clutching member corresponds to the end face at one side of the first clutching member and is formed into an extending engaging block. The first extending engaging block and second extending engaging block are different from that of the first clutching member.

Yet another aspect of the present invention is to provide an abdominal exerciser having a framework mounted with a moveable mechanism, characterized in that the moveable mechanism has a main shaft end portion mounted with a leg-hooking module, and the top face of the middle of the main shaft is provided with a seat pad with a back support at the end. The main shaft between the two securing plates is provided with a twisting module, and the twisting module is provided with a clutching seat corresponding to and rotating about the bottom face of the main shaft. The end face of the two lateral sides of the clutching seat correspond to one side of the leg-hooking module and extends with an extending engaging block. Within the clutching seat a horizontal shaft is provided for the mounting of the framework. The framework includes a first supporting frame and a second supporting frame. The top portion of the two ends of the first supporting frame is a first clutching member which corresponds to the rod. The first clutching member is mounted at the external side of the clutching member at the main shaft. The end faces of the two lateral sides of the first clutching member are formed into an extending engaging block which is different from the extending engaging block of the inner clutching member. The top portion of the two ends of the second supporting frame is formed into the second clutching member which can be pivotally mounted to the rod. The second mounting member is mounted at the external side of the first clutching member. The second clutching member corresponding to the end face at one side of the first clutching member is formed into an extending engaging block. The first extending engaging block and the second extending engaging block are different from that of the first clutching member.

Still another object of the present invention is to provide an abdominal exerciser, wherein the main shaft is mounted with a hollow clutching member and the bottom edge of the clutching member is formed into an extending engaging block. The interior of the clutching member is mounted with a downward facing pivotal shaft for the mounting of a clutching seat. The clutching seat has a hollow upright tube and a hollow horizontal tube, and the top face of the upright tube is formed into an extending engaging block which can be placed at the bottom end of the clutching member. The extending engaging block at the end face of the two lateral sides of the clutching seat is formed at the end face of the horizontal tube and the horizontal tube of the clutching seat is used for the passing through of the clutching seat so that the moveable mechanism is pivotally mounted to the framework.

The foregoing object and summary provide only a brief introduction to the present invention. To fully appreciate these and other objects of the present invention as well as the invention itself, all of which will become apparent to those skilled in the art the following detailed description of the invention and the claims should be read in conjunction with the accompanying drawings. Throughout the specification and drawings identical reference numerals refer to identical or similar parts.

Many other advantages and features of the present invention will become apparent to those versed in the art upon making reference to the detailed description and the accompanying sheets of drawings in which a preferred structural embodiment incorporating the principles of the present invention is shown by way of illustrative example.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
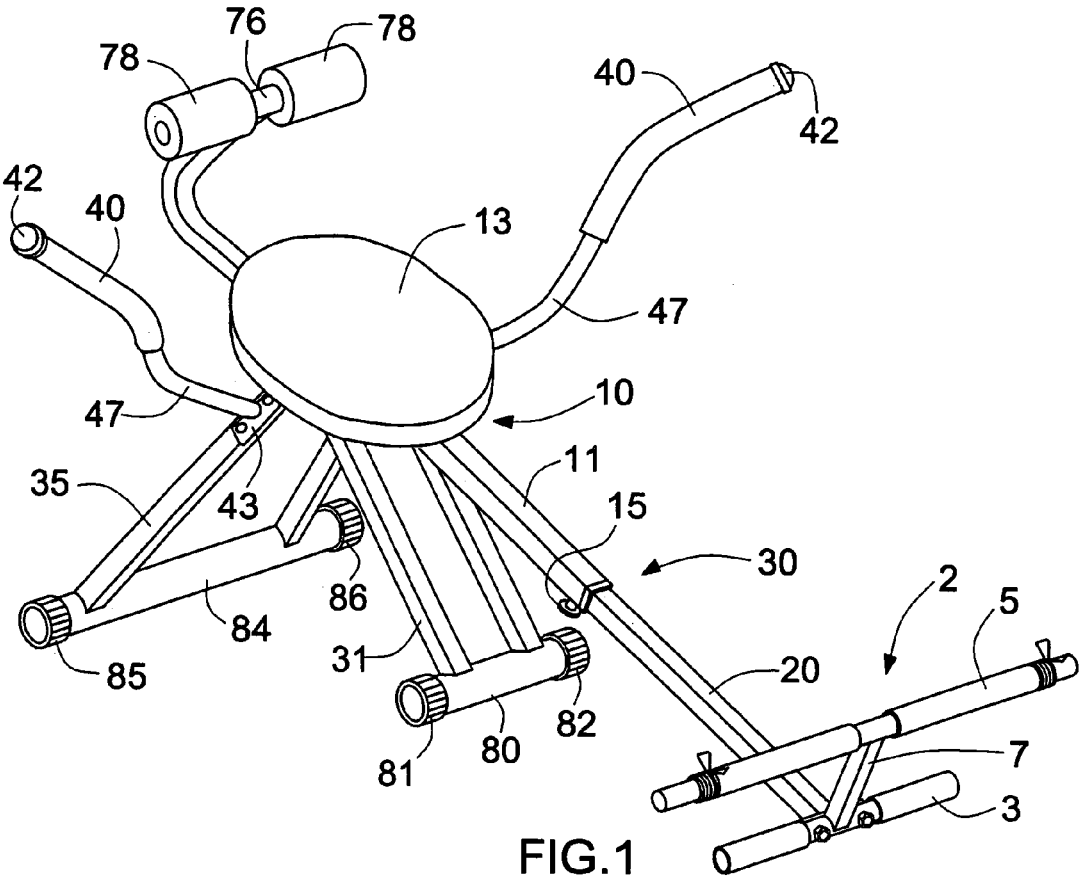
FIG. 1 is a perspective view of the fully assembled abdominal exerciser of the present invention.
Figure 3:
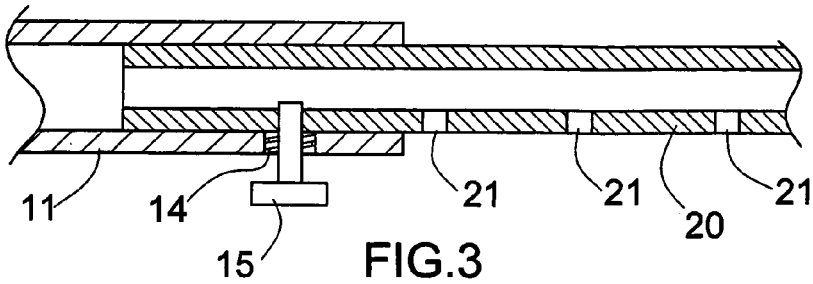
FIG. 3 is a cross-sectional view of a portion of the main frame illustrating the way the length of the main frame can be extended or shortened.
Figure 2:
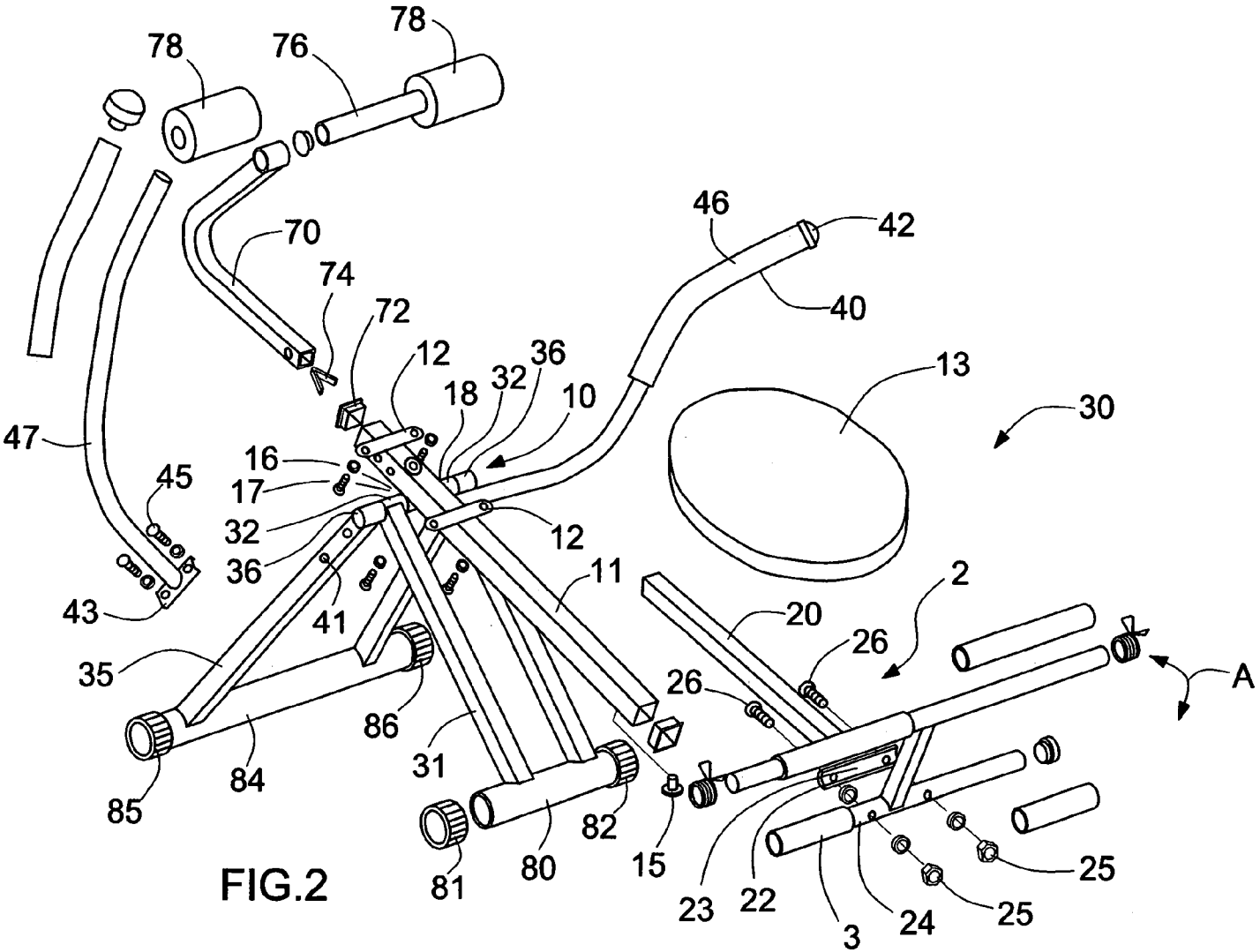
FIG. 2 is a perspective exploded view of the abdominal exerciser in accordance with the present invention.

Referring to FIGS. 1 and 2, there is shown an abdominal exerciser having a framework 30 pivotally mounted with a moveable mechanism 10 and the mechanism allowing the user to sit thereon. The framework 30 is retractable and can be folded when not in use.

The movable mechanism 10 comprises a main shaft 11 and a leg hooking module 2. The top face of the end of the hollow main shaft 11 is provided with a series of securing plates 12. A seat pad 13 is fastened to the securing plates 12. A seat pad 13 is fastened to the securing plates 12 by means of screws and nuts. The bottom face of the other end of the main shaft 11 is provided with a screw hole mount 14 installed with an adjustable bottom 15.

Referring to FIGS. 2, 4, 4A, 4B, 5, 5A, 5B and 10, the two lateral walls of the main shaft 11 corresponding to the middle section of seat pad 13 have extending therefrom an inner clutching member 16. The end face of the inner clutching member 16 corresponding to one lateral side of the leg-hooking module 2 has extending therefrom an extending engaging block 17. The interior of the inner clutching member 16 is provided with a shaft rod 18 for pivotal mounting of the framework 30. The threaded plugs 19 at the two ends of ths shaft rod 18 limit the framework 30 from dislocation. The leg hooking module 2 comprises a lower horizontally extending shaft 3, and an upper horizontally extending shaft 5 which are separated by a transverse bar 7 of sufficient length to enable the feet of the user to be inserted between shafts 3 and 5 on opposite sides of transverse bar 7. The middle of lower shaft 3 of leg-hooking module 2 is attached to a sliding rod 20 which is inserted into the hollow interior of main shaft 11. The bottom face of the sliding rod 20 includes a series of spaced apart adjusting holes 21 for adjusting the length of the sliding rod 20 by means of the adjusting button 15 on the man shaft 11. One end of sliding rod 20 is a semi-circular combining plate 22 and the two lateral sides of the combining plate 22 are formed into a long arch-slot 23 for mounting the rod 24 which extends through lower horizontally extending shaft 3. The screw nut 25 and mounts 26 are used so that the leg-hooking rod 24 can be mounted onto the combining plate 22, and the leg-hooking rod 24 enables the leg-hooking module 2 to rotate about the sliding rod 20 in the direction of Arrow A.

The framework 30 includes a first supporting frame 31 and a second supporting frame 35. The frames 31 and 35 are pivotably mounted together as best illustrated in FIG. 2. The first supporting frame 31 can be fully closed to the inner edge of second supporting frame 35. The top portions of the two ends of the first supporting frame 31 are respectively formed into the first clutching member 32, which is pivotally mounted to the shaft rod 18. The first clutching member 32 is mounted at the external side of inner clutching member 16 of the main shaft 11. The end face of the two lateral sides of the first clutching member 32 are respectively formed into two extending blocks 33 and 34 which are different from the engaging block 17 of the inner clutching member 16 so that the pivotal movement of the movable mechanism is restricted as illustrated in FIGS. 4A and 5A. The top sections of the two ends of the second supporting frame 35 are formed into a second clutching member 36 corresponding to the shaft rod 18. The second clutching member 36 is positioned at the external side of first clutching member 32. The second clutching member 36 corresponding to the end face of one lateral side of the first clutching member 32 is provided with an extending engaging block 37 which is different from the extending engaging block 33 of the first clutching member 32 so that the extended angle of the first and second supporting frames 31 and 35 are restricted as shown in FIGS. 4B and 5B.

The middle sections of the external edge at two lateral sides of the second supporting frame 35 are threaded openings 41 to receive a mounting plate 43 through threaded bolts 45. The mounting plate 43 in turn is attached to a handgrip tube 47 which in turn is attached to a hand grip 40. The top end of the handgrip 40 is mounted with an end plug 42. There are a pair of handgrips attached on opposite sides of second supporting frame 35, as illustrated in FIG. 1. The handgrips 40 may have foam 46 on its exterior for better gripping.

Inserted into the ends of main frame 11 opposite the end into which sliding rod 20 was inserted is a back support tube 70. The tube 70 is inserted through an inner spacer 72 and retained in the main frame by a V-clip 74. A horizontal bar 76 supports the foam tubing 78 on opposite sides of tube 70.

Figure 12:
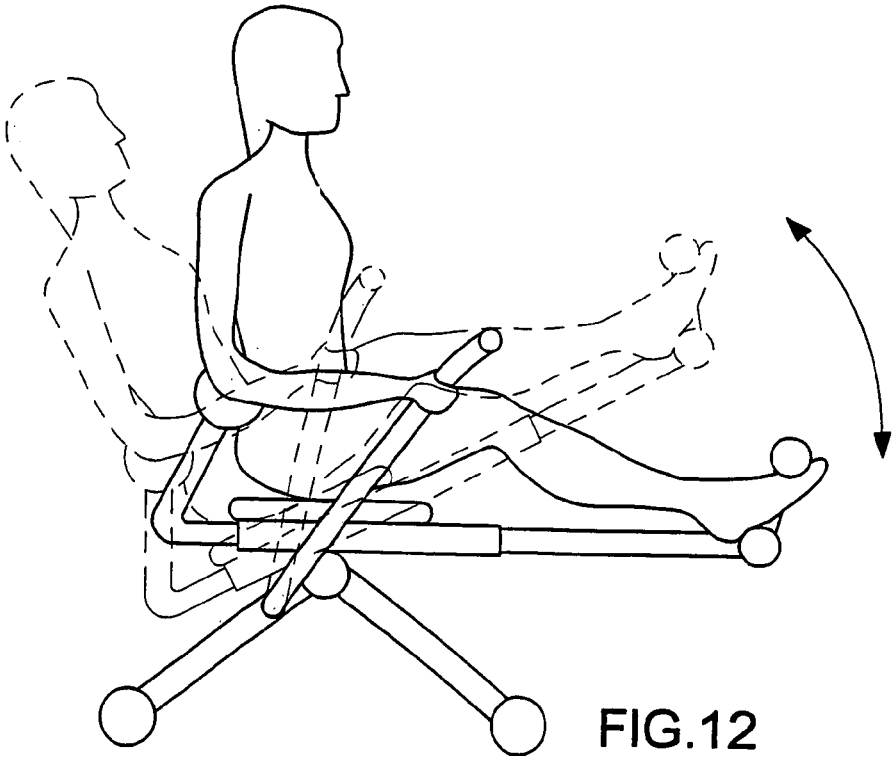
FIG. 12 is a schematic view showing the abdominal exerciser in use with the seesaw up and down action.
Figure 7:
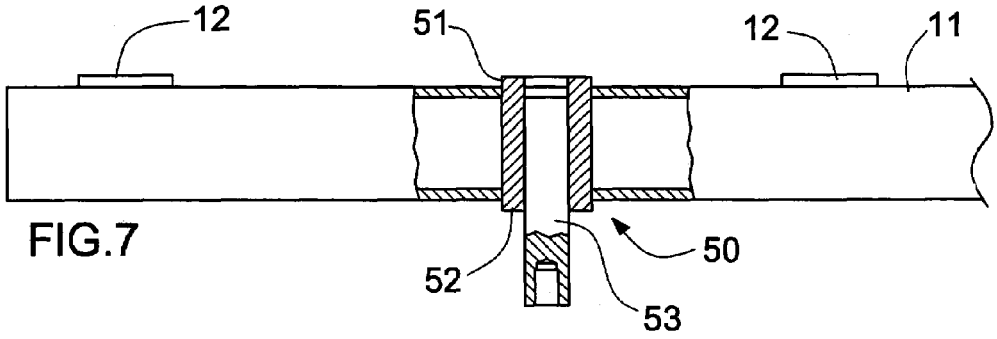
FIG. 7 is a side view in partial cross section of the swiveling mechanism of the present invention.
Figure 8:
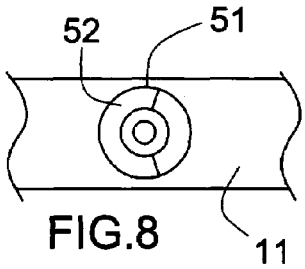
FIG. 8 is a top plan view of a portion of the main frame which retains a portion of the swiveling mechanism.

The seesaw up and down motion of the abdominal exerciser of the present invention will now be described with reference to FIGS. 1, 5, 5A, 5B and 12. The first and second support frames 31 and 35 are extended outward as illustrated in FIG. 1. First support frame 31 rests around tubing 80 with oppositely disposed rubber caps 81 and 82 at each respective end. The second support frame 35 rests on a round tubing 84 with oppositely disposed rubber caps 85 and 86. The extended engaging blocks 33 and 37 of the first and second clutching members 32 and 36 are used to restrict the first and second support frames 31 and 35 as shown in FIG. 5B. When the first and second supporting frames 31 and 35 have been extended to a certain angle, the extension will be stopped and the abdominal exerciser can be set on the floor as shown in FIG. 1. The user can sit on the seat pad 13 and the legs of the user are inserted between the generally H-shaped leg hooking module 2 with the legs inserted between horizontally extending shafts 3 and 5 so that the upper portion of each foot rests underneath upper horizontally extending shaft 5 and the bottom of each foot rests on lower horizontally extending shaft 3 as illustrated in FIG. 12. Based on the length of the user's legs, the distance between the seat pad 13 and the leg hooking module 2 can be extended by means of adjustment button 15 being inserted into the desired adjusting hole 21 on the sliding rod 20. The user's legs and feet can be firmly hooked onto the leg hooking module 2 to enable the user to proceed with various exercises in accordance with the present invention.

When the user sits on the seat pad 13, the center of gravity is at the outside and due to the restriction of the extended engaging blocks 17 and 34 as shown in FIG. 5A, the center of gravity will move slightly backward but will not fully turn over.

Figure 6:
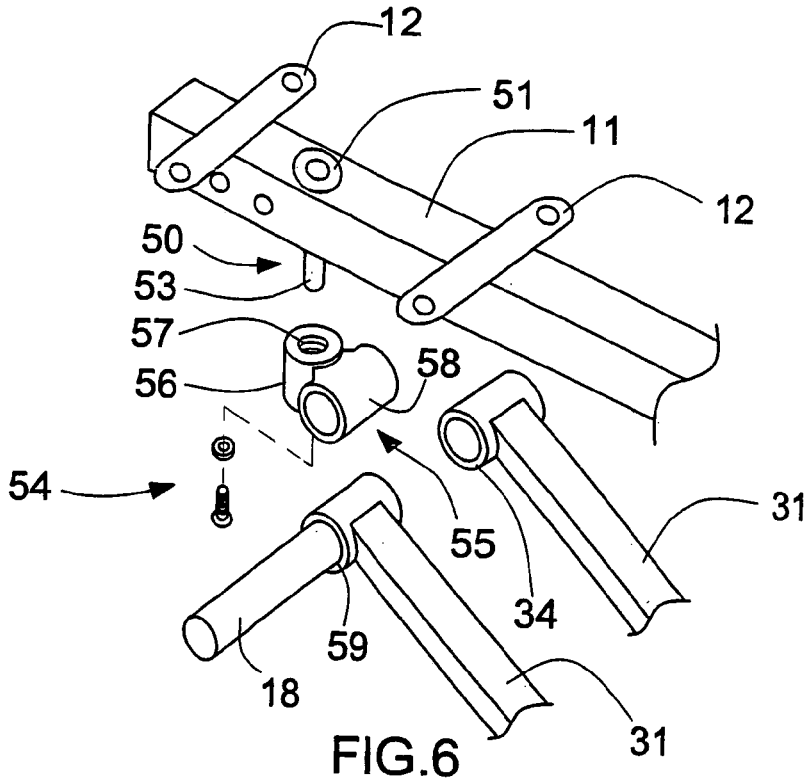
FIG. 6 is an exploded view of the seesaw up and down and swiveling mechanisms of the abdominal exerciser.

As illustrated in FIG. 6, for the seesaw up and down abdominal exerciser, the user holds onto the handlebars 40 and the user's back is against back support 70 and the user leans back against the back support and lifts his/her legs so that the main shaft 11 and sliding rod rotate about rod 18.

Figure 4:
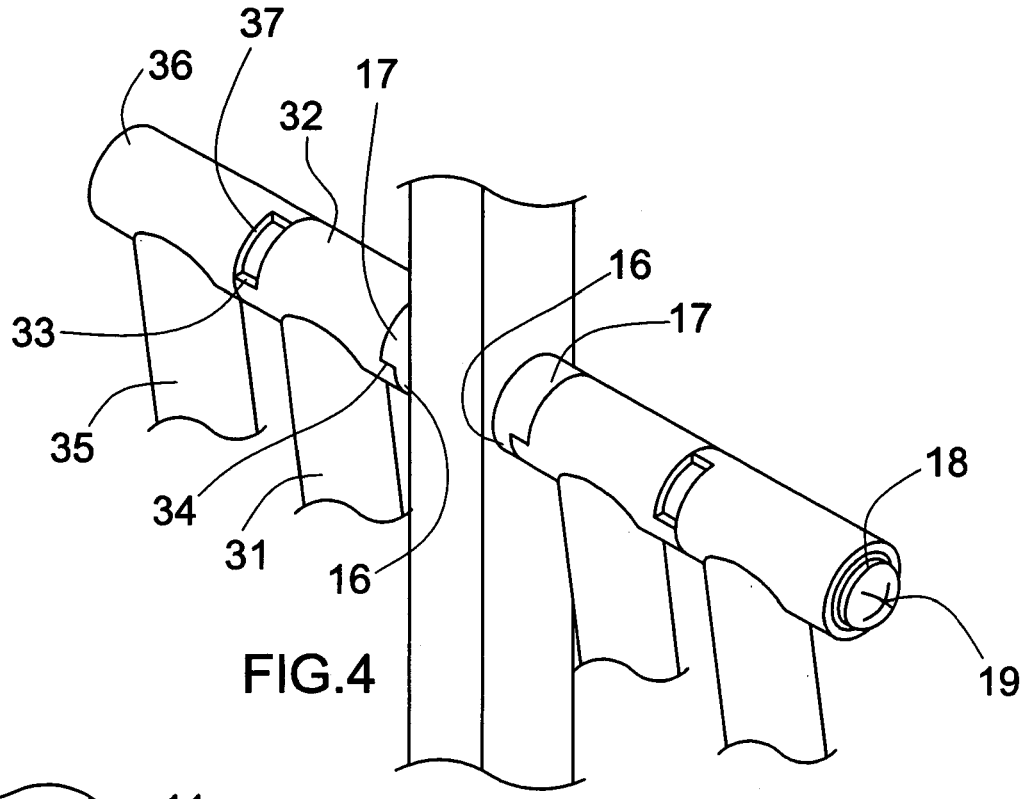
FIG. 4 is a is perspective view of the seesaw up and down mechanism of the abdominal exerciser after it is folded.
Figure 4A:
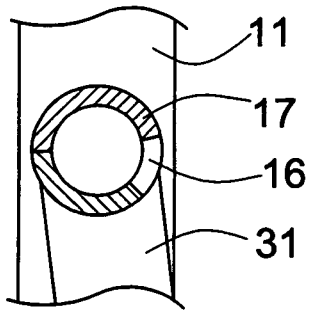
FIG. 4A is a cross-sectional view of a portion of the seesaw up and down mechanism of the abdominal exerciser after it has been folded.
Figure 4B:
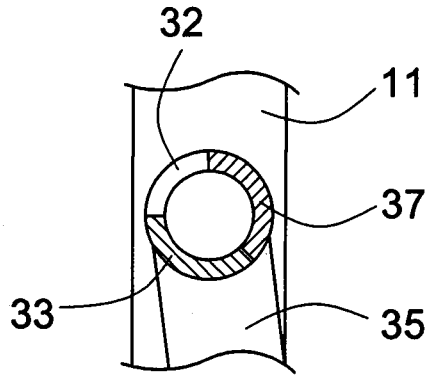
FIG. 4B is another cross-sectional view of a portion of the seesaw up and down mechanism of the abdominal exerciser after it has been folded.
Figure 5:
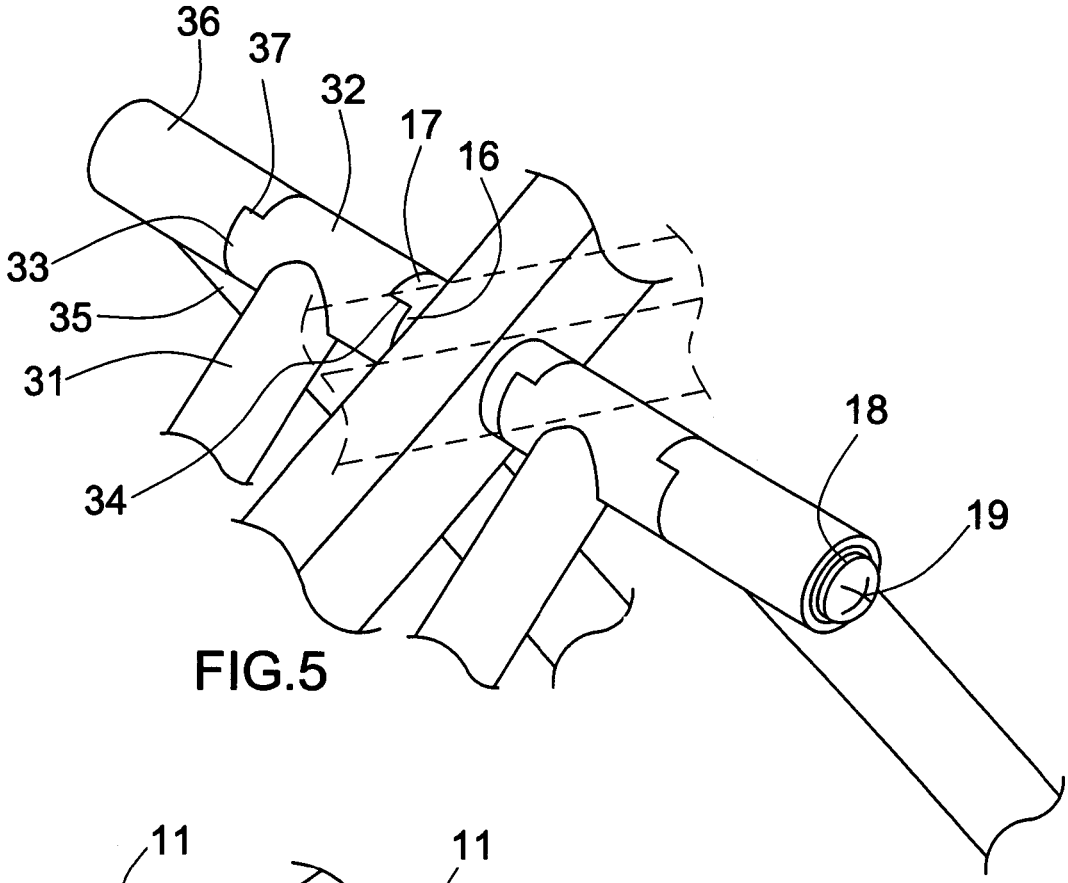
FIG. 5 is a perspective view of the seesaw up and down mechanism of the abdominal exerciser with the abdominal exerciser in the opened condition.
Figure 5A:
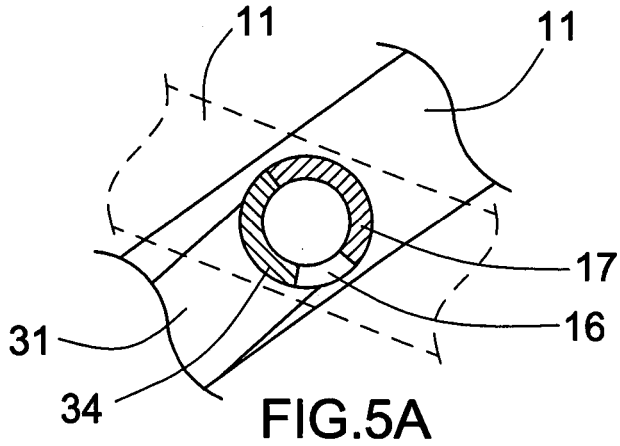
FIG. 5A is a cross-sectional view of a portion of the seesaw up and down mechanism of the abdominal exerciser with the abdominal exerciser in the opened and in use condition.
Figure 5B:
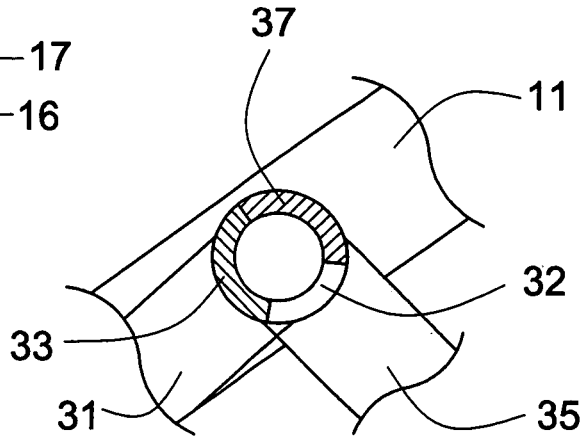
FIG. 5B is another cross-sectional view of a portion of the seesaw up and down mechanism of the abdominal exerciser with the abdominal exerciser in the opened and in use condition.

When the user wants to fold the exerciser which is illustrated in FIGS. 4, 4A and 4B, the abdominal exerciser is lifted and the first supporting frame 31 can be fully folded against the second supporting frame 35, and the main shaft 11 of the movable mechanism 10 can also be fully positioned to the framework 30. Thus the exerciser is folded and the space for storage is saved.

A second exercise which can be performed with the abdominal exerciser is a swiveling motion. Referring to FIGS. 2, 6, 9, 11A and 11B, the main shaft 11 of the movable mechanism 10, between the securing plates 12 is mounting with a twisting module 50. The twisting module 50 on the main shaft 11 is mounted with a hollow clutching member 51. The bottom edge of the clutching member 51 is provided with an extended engaging block 52. The clutching member 51 is welded with a downward extended pivotal shaft 53 for the pivotal mounting of a clutching seat 55. The bottom end of the pivotal end is provided with a screw hole and a screw nut 54 is used to restrict the clutching seat 55. The clutching seat 55 is spacedly mounted with hollow upright tube 56 and hollow horizontal tube 58, and the top face of the upright tube 56 has an extended engaging block 57 which is different from the extended engaging block 52 of the clutching member 51. The extended engaging block 57 is suitably placed at the bottom of the clutching member 51, different from the range of the extended engaging block 52 to form a restriction for the rotation.

Figure 9:
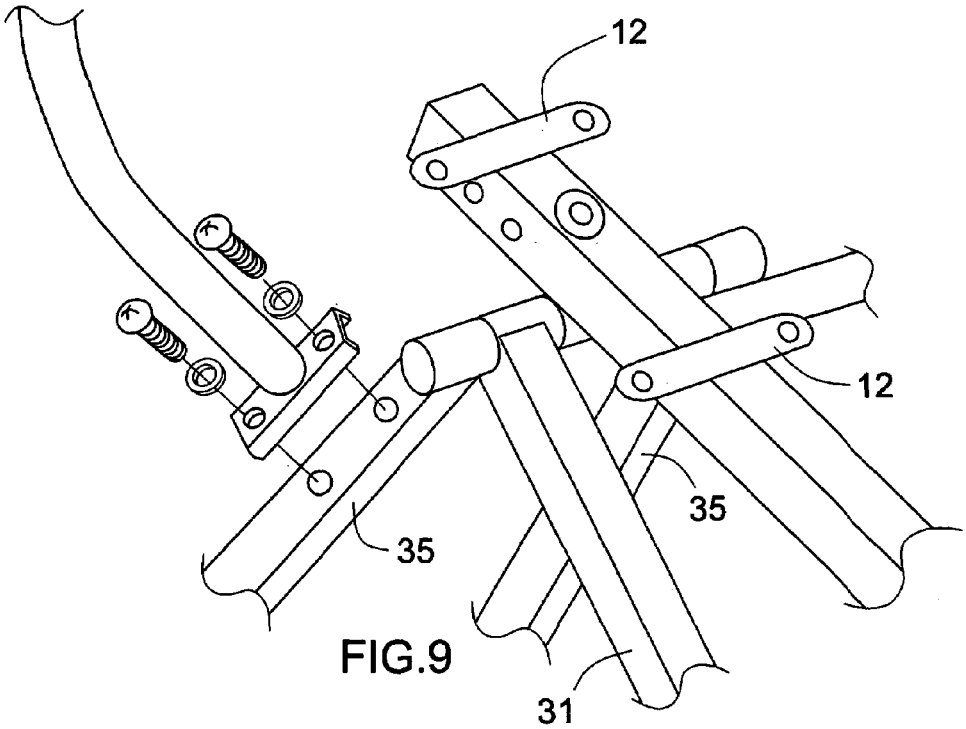
FIG. 9 is a partially exploded view of the main frame of the abdominal exerciser illustrating the way the handle is attached.

Further, the end face of the two lateral sides of the horizontal tube 58 of the clutching seat 55, corresponding to one side of the leg-hooking module, is provided with an extended engaging block 59. The extended engaging block 59 is corresponding to the range outside the external engaging block 34 of the first supporting frame 31 of the framework 30. The horizontal tube of the clutching seat 55 is used for the mounting of the shaft rod 18 so that the movable mechanism 10 can be pivotally mounted to the framework 30, as shown in FIG. 9. The user can swivel or twist the seat pad 13 to create a waist twisting exercise.

Figure 10:
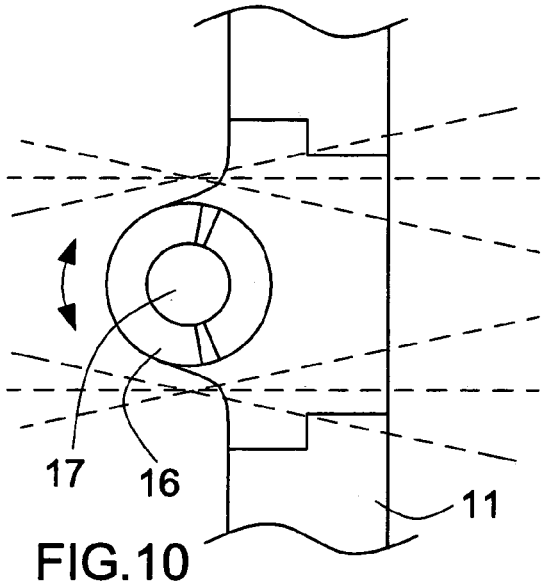
FIG. 10 is a side elevational view illustrating the seesaw up and down motion of the abdominal exerciser.
Figure 11:
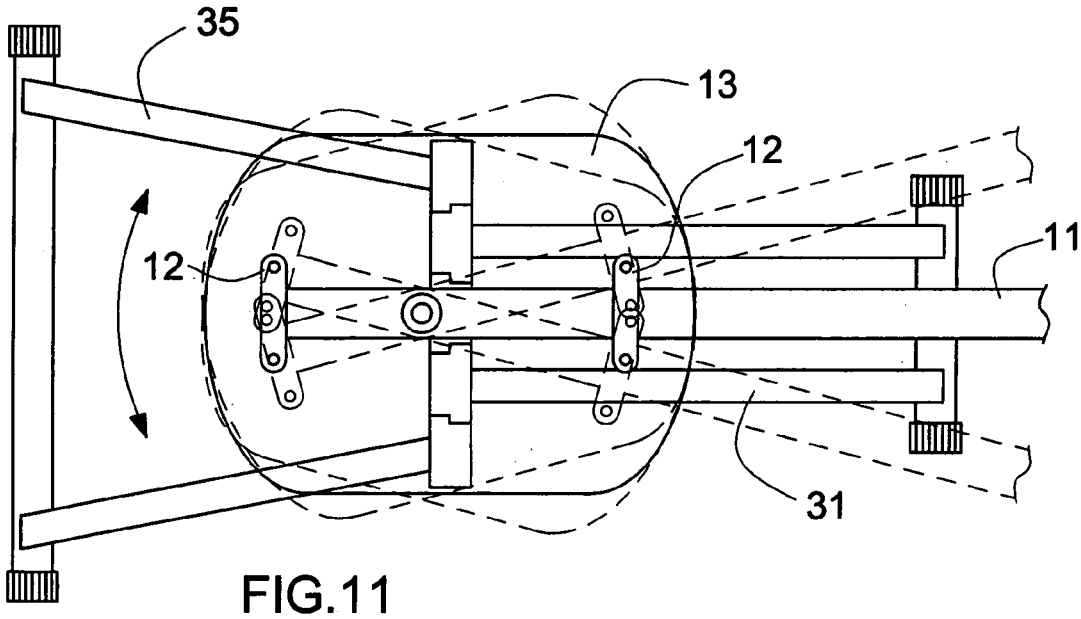
FIG. 11 is a top plan view illustrating the swiveling motion of the abdominal exerciser.

Therefore, the exercises which can be performed with the abdominal exerciser are illustrated in FIGS. 10, 11 and 12. For the seesaw up and down motion, the user sits as illustrated in FIG. 12 and rocks or rotates as illustrated in FIG. 12. The seesaw up and down motion about shaft 18 is shown in dashed lines in FIG. 10. Concurrently and/or alternatively, the user can also perform a twisting or swiveling exercise going in the horizontal plane about pivotal shaft 53 rotating in clutching seat 55. The range of swiveling or twisting motion is illustrated in FIG. 11 by the dashed lines.

Therefore, the through use of the novel clutching mechanisms as discussed and illustrated, the user can concurrently perform horizontal, vertical and diagonal motions at every angle between the vertical and horizontal planes, to fully exercise all abdominal muscles. As described, the seat 13 rests on a central beam 11 containing a rotational joint (51, 52, 53, 56, 57) whose vertical axis extends from the floor to the ceiling. This rotational joint in turn is welded to a hinge joint (55, 58) that allows the leg extension to rotate around a horizontal axis up to a fixed angle, extending from the left to the right side of the apparatus.

The rotational joint allows lateral movement (side-to-side swiveling), while the hinge joint allows vertical movement (up-and-down dipping). The result is a freedom of movement constrained only by the range of movement actually allowed by the waist and hips of the user.

While the invention has been described with respect to preferred embodiments, it will be clear to those skilled in the art that modifications and improvements may be made to the invention without departing from the spirit and scope of the invention. Therefore, the invention is not to be limited by the specific illustrative embodiment, but only by the scope of the appended claims.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Defined in detail, the present invention is an abdominal exerciser having a framework mounted with a moveable mechanism characterized in that the moveable mechanism has a main shaft end portion mounted with a leg-hooking module and a top face of the end of the main shaft is provided with a seat pad, and two lateral walls of the main shaft corresponding to a middle section of the seat pad is extended with a hollow inner clutching member, the end face of the hollow clutching member corresponding to one lateral side of the leg-hooking module is extended with an extended engaging block, and the interior of the inner clutching member is provided with a rod for pivotal mounting, and the framework includes a first supporting frame and a second supporting frame, and the top portion of the two ends of the first supporting frame is a first clutching member which is supported on a rod; and the first clutching member is mounted at the external side of the clutching member at the main shaft, the end faces of the two lateral sides of the first clutching member are formed into an extended engaging block which is different from the extended engaging block of the inner clutching member, and the top portion of the two ends of the second supporting frame is formed into the second clutching member which is pivotally mounted to the rod, and the second mounting member is mounted at the external sides of the first clutching member, and the second clutching member corresponding to the end face at one side of the first clutching member is formed into an extended engaging block; and the extended engaging block is different from that of the first clutching member.

Defined alternatively, the present invention is an abdominal exerciser having a framework mounted with a moveable mechanism, characterized in that the moveable mechanism has a main shaft end portion mounted with a leg-hooking module, and a top face of the end of the main shaft is provided with a seat pad, and the main shaft between two securing plates which retain the seat pad is provided with a twisting module, and the twisting module is provided with a clutching seat corresponding to and rotating about the bottom face of the main shaft, and the end face of the two lateral sides of the clutching seat corresponding to one side of the leg-hooking module is extended with an extended engaging block, and within the clutching seat a horizontal shaft is provided for the mounting of the framework; the framework includes a first supporting frame and a second supporting frame, and the top portion of the two ends of the first supporting frame is a first clutching member which is supported on a rod, and the first clutching member is mounted at the external side of the clutching member at the main shaft, the end faces of the two lateral sides of the first clutching member are formed into an extended engaging block which is different from the extended engaging block of the inner clutching member, and the top portion of the two ends of the second supporting frame is formed into the second clutching member which is pivotally mounted to the rod, and the second mounting member is mounted at the external side of the first clutching member, and the second clutching member corresponding to the end face at one side of the first clutching member is formed into an extended engaging block; and the extended engaging block is different from that of the first clutching member.

Defined broadly, the present invention is an abdominal exerciser, comprising: (a) a frame which supports a seat on a top portion and a leg hooking module adjacent one end; (b) the frame comprising twisting means to enable the seat to be caused to move in a twisting motion; (c) the frame further comprising pivoting means to enable the seat to move in a pivotal seesaw motion; and (d) the twisting means and the pivoting means acting concurrently to enable horizontal, vertical and diagonal motion of the seat at every angle between vertical and horizontal planes.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. An abdominal exerciser having a framework mounted with a moveable mechanism characterized in that the moveable mechanism has a main shaft end portion mounted with a leg-hooking module and a top face of the end of the main shaft is provided with a seat pad, and two lateral walls of the main shaft corresponding to a middle section of the seat pad is extended with a hollow inner clutching member, the end face of the hollow clutching member corresponding to one lateral side of the leg-hooking module is extended with an extended engaging block, and the interior of the inner clutching member is provided with a rod for pivotal mounting, and the framework includes a first supporting frame and a second supporting frame, and the top portion of the two ends of the first supporting frame is a first clutching member which is supported on a rod; and the first clutching member is mounted at the external side of the clutching member at the main shaft, the end faces of the two lateral sides of the first clutching member are formed into an extended engaging block which is different from the extended engaging block of the inner clutching member, and the top portion of the two ends of the second supporting frame is formed into the second clutching member which is pivotally mounted to the rod, and the second mounting member is mounted at the external sides of the first clutching member, and the second clutching member corresponding to the end face at one side of the first clutching member is formed into an extended engaging block; and the extended engaging block is different from that of the first clutching member.

2. The abdominal exerciser of claim 1, wherein on either side of the main shaft corresponding to the seat pad has a series of securing plates, and screw nuts are used to lock to the seat pad to the main shaft through the securing plates.

3. The abdominal exerciser of claim 1, wherein the two ends of the rod of the main shaft are provided with a threaded plug to prevent the dislocation of the framework.

4. The abdominal exerciser of claim 1, wherein the main shaft corresponding to the bottom face of the end portion of the leg-hooking module is a threaded hole mounted with an adjustable button, and the leg-hooking module has a sliding rod mounted to the main shaft and the bottom edge face of the sliding rod is provided with a series of adjusting holes corresponding to the adjusting button on the main shaft.

5. The abdominal exerciser of claim 4, wherein one end extended by the sliding rod of the leg-hooking module is provided with a combining plate of semi-circular shape, and the two sides of the combining plates have a long arch-shape slot so that the leg-hooking rod is mounted onto the combining plate using a screw nut and screw bolt, allowing the leg-hooking module to rotate with respect to the sliding rod.

6. The abdominal exerciser of claim 1, wherein the first and the second supporting frame are each formed of a pair of beams mounted to a transverse tubular bar with end caps at each end of the bar.

7. The abdominal exerciser of claim 1, wherein the middle section at the external edge of the two lateral sides of the second supporting frame further comprise means to retain handgrips on each side of the abdominal exerciser.

8. The abdominal exerciser of claim 7, wherein the top end of each handgrip has an end plug to provide anti-slipping and allow the holding at the upper end for massaging the hands.

9. The abdominal exerciser of claim 1, further comprising a back support mounted to the end of the main shaft remote from the leg-hooking module.

10. An abdominal exerciser having a framework mounted with a moveable mechanism, characterized in that the moveable mechanism has a main shaft end portion mounted with a leg-hooking module, and a top face of the end of the main shaft is provided with a seat pad, and the main shaft between two securing plates which retain the seat pad is provided with a twisting module, and the twisting module is provided with a clutching seat corresponding to and rotating about a bottom face of the main shaft, and an end face of two lateral sides of the clutching seat corresponding to one side of the leg-hooking module is extended with an extended engaging block, and within the clutching seat a horizontal shaft is provided for the mounting of the framework; the framework includes a first supporting frame and a second supporting frame, and the top portion of the two ends of the first supporting frame is a first clutching member which is supported on a rod, and the first clutching member is mounted at the external side of the clutching member at the main shaft, the end faces of the two lateral sides of the first clutching member are formed into an extended engaging block which is different from the extended engaging block of the inner clutching member, and the top portion of the two ends of the second supporting frame is formed into the second clutching member which is pivotally mounted to the rod, and the second mounting member is mounted at the external side of the first clutching member, and the second clutching member corresponding to the end face at one side of the first clutching member is formed into an extended engaging block; and the extended engaging block is different from that of the first clutching member.

11. The abdominal exerciser of claim 10, wherein the main shaft is mounted with a hollow clutching member and the bottom edge of the clutching member is formed into an extended engaging block, and the interior of the clutching member is mounted with a downward facing pivotal shaft for the mounting of a clutching seat, and the clutching seat has a hollow upright tube and a hollow horizontal tube, and the top face of the upright tube is formed into an extended engaging block which can be placed at the bottom end of the clutching member, and the extended engaging block at the end face of the two lateral sides of the clutching seat is formed at the end face of the horizontal tube and the horizontal tube of the clutching seat is used for the passing through of the clutching seat so that the moveable mechanism is pivotally mounted to the framework.

12. The abdominal exerciser of claim 11, wherein the bottom end of the pivotal shaft of the twisting module is provided with screw hole for the restriction of the clutching seat using a limiting screw.

13. The abdominal exerciser of claim 10, wherein the top face of the main shaft has a series of securing plates and screw nuts are used to secure the seat pad to the main shaft.

14. The abdominal exerciser of claim 10, wherein the two ends of the rod of the main shaft are provided with a threaded plug to prevent the dislocation of the framework.

15. The abdominal exerciser of claim 10, wherein the main shaft corresponding to the bottom face of the end portion of the leg-hooking module is a threaded hole mounted with an adjustable button, and the leg-hooking module has a sliding rod mounted to the main shaft and the bottom edge face of the sliding rod is provided with a series of adjusting holes corresponding to the adjusting button on the main shaft.

16. The abdominal exerciser of claim 15, wherein one end extended by the sliding rod of the leg-hooking module is provided with a combining plate of semi-circular shape, and the two sides of the combining plates have a long arch-shape slot so that the leg-hooking rod is mounted onto the combining plate using a screw nut and screw bolt, allowing the leg-hooking module to rotate with respect to the sliding rod.

17. The abdominal exerciser of claim 10, wherein the first and the second supporting frames are each formed of a pair of beams mounted to a transverse tubular bar with end caps at each end of the bar.

18. The abdominal exerciser of claim 10, wherein the middle section at the external edge of the two lateral sides of the second supporting frame further comprise means to retain handgrips on each side of the abdominal exerciser.

19. The abdominal exerciser of claim 10, wherein the top end of each handgrip has an end plug to provide anti-slipping and allow the holding at the upper end for massaging the hands.

20. The abdominal exerciser of claim 10, further comprising a back support mounted to the end of the main shaft remote from the leg-hooking module.

21. An abdominal exerciser, comprising:

a. a frame which supports a seat on a top portion and a leg hooking module adjacent one end;

b. said frame comprising twisting means to enable said seat to be caused to move in a twisting motion;

c. said frame further comprising pivoting means to enable said seat to move in a pivotal seesaw motion; and d. said twisting means and said pivoting means acting concurrently to enable horizontal, vertical and diagonal motion of the seat at every angle between vertical and horizontal planes.

22. An abdominal exerciser in accordance with claim 21, further comprising a pair of oppositely disposed hand gripping means on opposite sides of the frame.

23. An abdominal exerciser in accordance with claim 22, further comprising a back support mounted to said frame at an end remote from the leg-hooking module.

* * * * *